US006357238B1

(12) United States Patent
Brothers

(10) Patent No.: US 6,357,238 B1
(45) Date of Patent: Mar. 19, 2002

(54) WITHDRAWAL DEVICE FOR A CRYOGENIC TANK

(76) Inventor: John G. Brothers, 18201 Fox Pointe, Clinton Township, MI (US) 48038

( * ) Notice: Subject to any disclaimer, the term of this patent is extended or adjusted under 35 U.S.C. 154(b) by 0 days.

(21) Appl. No.: 09/753,383

(22) Filed: Jan. 3, 2001

(51) Int. Cl.[7] ..... F17C 7/04
(52) U.S. Cl. ..... 62/48.1; 62/50.1; 62/51.1
(58) Field of Search ..... 62/48.1, 50.1, 62/51.1

(56) References Cited

U.S. PATENT DOCUMENTS

| | | | | | |
|---|---|---|---|---|---|
| 2,996,893 | A | * | 8/1961 | Goodenough et al. | 62/50.1 |
| 3,440,829 | A | * | 4/1969 | Davies-White | 62/50.1 |
| 5,488,831 | A | * | 2/1996 | Griswold | 62/48.1 |
| 6,035,646 | A | * | 2/2000 | Griswold | 62/50.1 |

* cited by examiner

*Primary Examiner*—Ronald Capossela
(74) *Attorney, Agent, or Firm*—Gifford, Krass, Groh, Sprinkle, Anderson & Anderson, P.C.

(57) ABSTRACT

A withdrawal device is provided for use with a cryogenic tank having a neck in which the neck forms an opening to the interior of the tank. The withdrawal device includes a housing having a flange adapted to overlie and abut against the neck on the cryogenic tank. An elongated extraction tube has a first portion which extends into the interior of the tank and a second portion which extends laterally outwardly from the housing exteriorly of the tank. An axially compressible resilient annular seal is mounted to the housing so that one end of the seal abuts against the flange while a seal support overlies the opposite end of the seal. Both the seal support as well as the seal are dimensioned for insertion into the neck. An elongated rod extends through the housing and has one end secured to the seal support while a second end of the rod is positioned above the housing. A lever threadably engages the rod so that rotation of the lever relative to the housing compresses the seal between the seal support and flange thus causing the seal to expand radially outwardly and sealingly engage the interior surface of the neck opening.

4 Claims, 2 Drawing Sheets

WITHDRAWAL DEVICE FOR A CRYOGENIC TANK

BACKGROUND OF THE INVENTION

I. Field of the Invention

The present invention relates generally to a withdrawal device for use with a cryogenic tank.

II. Description of Related Art

Cryogenic tanks of the type designed to contain extremely cold liquids, such as liquid nitrogen, typically include a neck at the top of the tank. This neck has an interior throughbore open to the interior of the tank. Such cryogenic tanks are used in many applications, such as cryosurgery. When used in such applications, however, it is frequently necessary to withdraw a relatively small portion of the liquid from the tank using a withdrawal device.

There have been a number of previously known withdrawal devices for use with cryogenic tanks. These previously known devices typically comprise a housing having a flange which is adapted to abut against the top of the neck of the cryogenic tank. An elongated extraction tube then extends both through the housing and into the interior of the cryogenic tank as well as exteriorly of the cryogenic tank. With the housing secured to the neck, pressure caused by vaporization of the cryogenic liquid within the tank forces the cryogenic liquid out through the extraction tube and exteriorly of the cryogenic tank. Typically, a manually operated valve is fluidly connected in series with the extraction tube.

In order to fluidly seal the housing to the cryogenic tank, these previously known withdrawal devices typically include an annular seal having one end in abutment with the housing flange and dimensioned for insertion into the neck opening. A circular seal support supports the other end of the annular seal while a rod secured to the seal support extends upwardly through the flange. A nut then engages a threaded portion on the rod so that rotation of the nut axially compresses the seal and expands the seal radially outwardly into sealing engagement with the interior surface of the neck opening. This nut is oftentimes positioned at the base of the housing and just above the flange.

These previously known withdrawal devices, however, have not proven wholly satisfactory in use. One disadvantage of these previously known devices is that many require the use of a separate tool, such as a wrench, in order to tighten the annular seal into sealing engagement with the cryogenic tank. Still other previously known withdrawal devices include outwardly extending arms secured to the nut which permit the nut to be manually rotated. In either case, however, tightening of the nut is difficult to achieve.

A still further disadvantage of these previously known withdrawal devices is that the number of rotations of the nut, and therefore the axial compression of the seal, is unlimited. In many cases, over tightening of the nut results in over compression of the seal thus damaging the seal. When this occurs, it is necessary to repair the withdrawal device by replacing the seal with a new seal.

SUMMARY OF THE PRESENT INVENTION

The present invention provides a withdrawal device for a cryogenic tank which overcomes all of the above-mentioned disadvantages of the previously known devices.

In brief, the device of the present invention comprises a housing having a flange adapted to overlie and abut against the top of the neck of the cryogenic tank. An extraction tube has a first portion adapted to extend through the flange and into the interior of the tank. The extraction tube also includes a second portion which extends laterally outwardly from the housing and a fluid valve is fluidly connected in series with the second portion of the tube.

In order to fluidly seal the housing to the neck opening of the cryogenic tube, the withdrawal device of the present invention includes an annular seal having one axial end in abutment with the flange. A circular seal support overlies and supports the opposite end of the seal. Both the seal support and seal are dimensioned for insertion into the neck opening.

In order to axially compress the annular seal so that the seal expands radially outwardly, an elongated rod has one end secured to the seal support while its other end extends through the flange and housing so that the opposite end of the rod extends through the top of the housing. This second end of the rod, furthermore, is externally threaded.

A lever includes a nut at one end adapted to threadably engage the second or upper end of the rod. Consequently, with the lever nut threadably engaged with the upper rod end, rotation of the lever compresses the annular seal between the flange and the seal support thus expanding the seal radially outwardly into sealing engagement with the interior surface of the cryogenic tank neck.

Unlike the previously known devices, however, the second end of the rod is positioned within a recess in the lever so that the second end of the rod is aligned with a closed wall portion in the lever. Since the second end of the rod is positioned within the recess, the number of axial rotations of the lever, and thus the axial travel of the rod, is limited thereby preventing over tightening of the rod and over compression of the seal.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
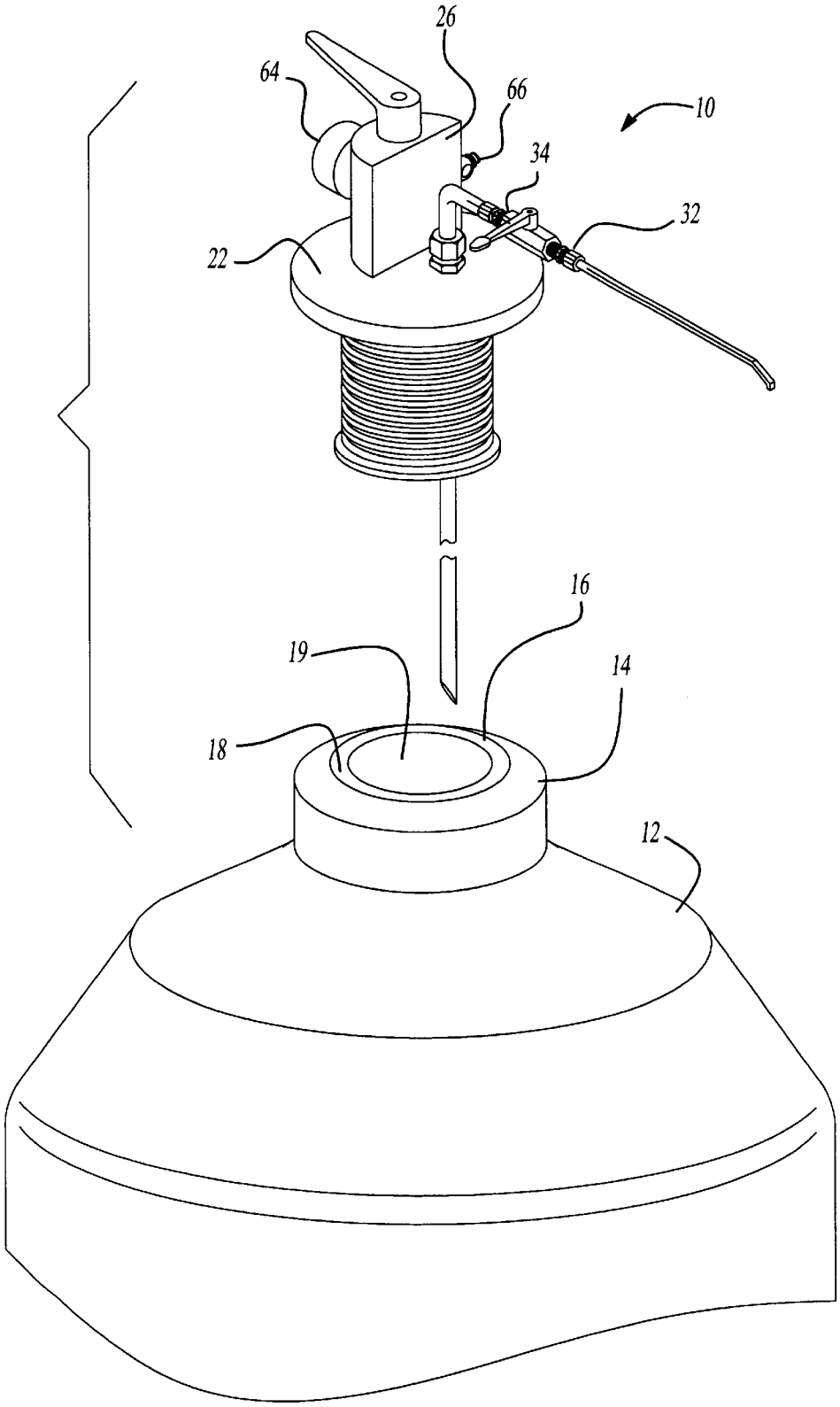
FIG. 1 is an exploded perspective view illustrating a preferred embodiment of the present invention.

With reference first to FIG. 1, a preferred embodiment of the withdrawal device 10 is there shown for use with a cryogenic tank 12. The cryogenic tank 12 is of the type designed to contain a cryogenic liquid, such as liquid nitrogen, and is generally cylindrical in shape having a reduced diameter neck 14 at its upper end. The neck 14 has an upper surface 16 as well as an opening 18 with an interior surface 19 to provide access into the interior of the tank 12 and thus access to the cryogenic liquid.

Figure 2:
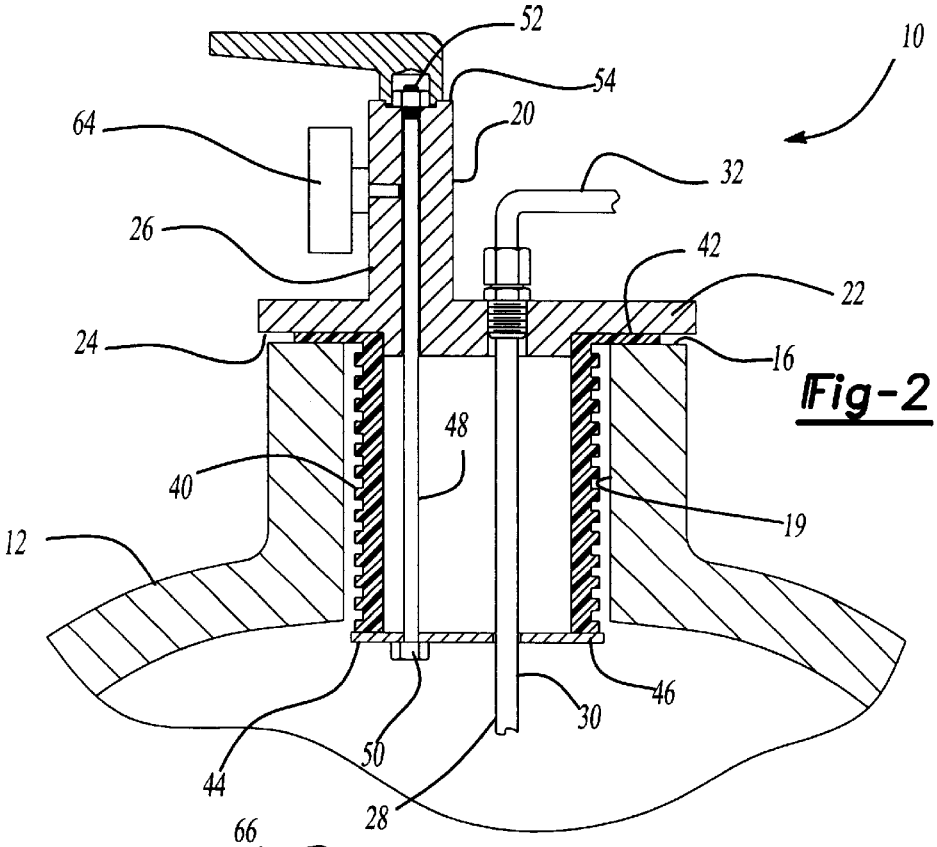
FIG. 2 is a sectional diagrammatic view illustrating the operation of the preferred embodiment of the present invention.

With reference now to FIG. 2, the withdrawal device 10 includes a housing 20 having a generally circular flange 22 with a lower surface 24 adapted to overlie the upper surface 16 of the tank neck 14. The housing 20 further includes an upwardly extending boss 26, and preferably, the boss 26 and flange 22 are of a one-piece construction.

An elongated extraction tube 28 has a first portion 30 which extends through the flange 22 and into the interior of the cryogenic tank 12 when the flange 22 is positioned on the neck 14. A second portion 32 of the extraction tube 28 extends laterally outwardly from the housing 20 exteriorly of the tank 12. A manually operated valve 34 (FIG. 1) of any conventional construction is fluidly connected in series with the second portion 32 of the extraction tube 28.

The withdrawal device 10 also includes a conventional pressure gauge 64 and pressure relief valve 66 (FIG. 1). The gauge 64 and relief valve 66 may be of any conventional construction.

Still referring to FIG. 2, in order to selectively fluidly seal the housing 20 to the cryogenic tank 12, the withdrawal device 10 includes an annular resilient and axially compressible seal 40 having one end 42 in abutment with the lower side 24 of the flange 22. A circular seal support 44 overlies and supports the opposite end 46 of the seal 40. Both the seal 40 and seal support 46 are dimensioned for insertion into the neck opening 18 of the cryogenic tank 12.

An elongated rod 48 has a first end 50 secured to the seal support 44 in any conventional fashion. The rod 40 extends upwardly through the flange 22 and boss 26 so that an upper end 52 protrudes upwardly from an upper end 54 of the boss 26. This second end 52 of the rod 48, furthermore, is externally threaded.

Figure 3:
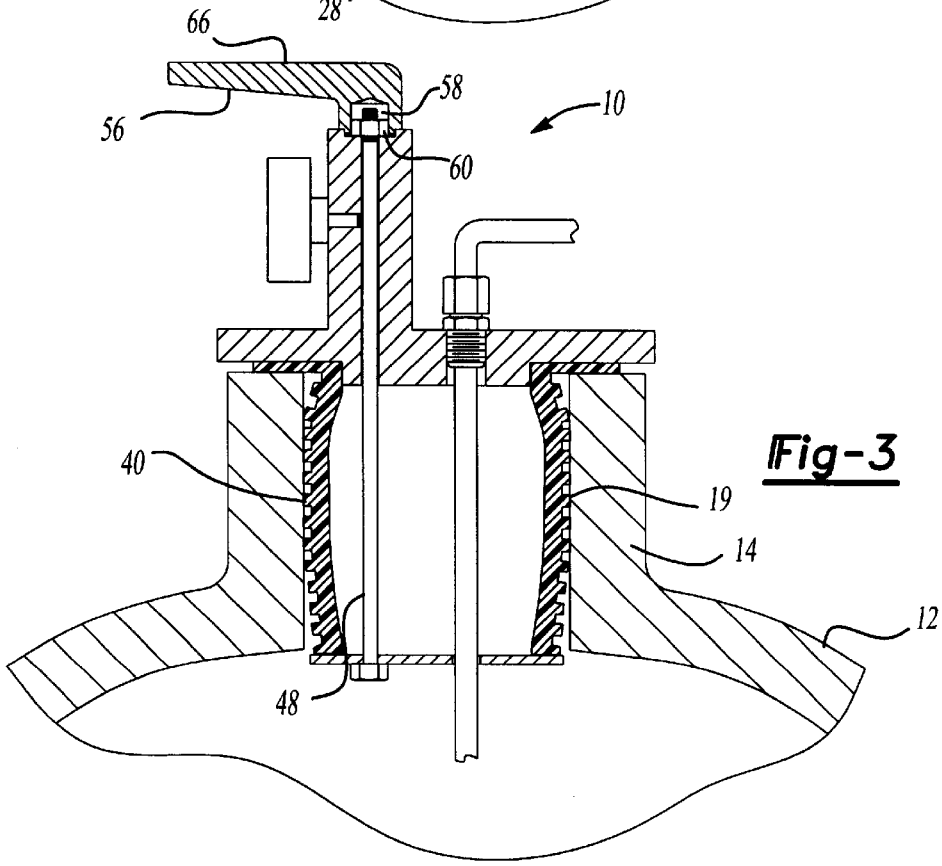
FIG. 3 is a view similar to FIG. 2 but illustrating the seal in a compressed state.

Referring now particularly to FIG. 3, an elongated lever 56 includes a recess 58 formed in one end. An internally threaded nut 60 is fixedly secured to the lever 56 within the recess 58 so that the nut 60 and lever 56 move in unison with each other. Furthermore, the nut 60 threadably cooperates with the threaded end 52 of the rod 48.

With the seal 40 in a generally uncompressed state (FIG. 2), the seal 40 and seal support 44 are inserted into the neck opening 18 so that the lower surface 24 of the flange 22 overlies the top 16 of the neck 14. At this time, the lever nut 60 is threadably engaged with the threaded end 52 of the rod 48 so that the end 52 of the rod 48 is positioned within the recess 58.

Rotation of the lever 56 as shown in FIG. 3 axially compresses the seal 40 so that the seal 40 expands radially outwardly into sealing engagement with the interior surface 19 of the neck 14. However, since the rod end 52 is positioned within the lever recess 58, a closed wall portion 66 forming the inner end of the recess 58 registers with the rod end 52 and limits the axial travel of the rod 48. In doing so, over compression of the seal 40 is completely avoided.

With the withdrawal device fluidly sealed to the cryogenic tank 12 as shown in FIG. 4, vaporization of the cryogenic liquid within the tank 12 creates a pressure within the tank 12. Thus, by opening the valve 36, this internal tank pressure forces the cryogenic liquid out through the extraction tube 28 in the desired fashion. With the valve 34 closed, however, the pressure relief valve 66 ensures against excessively high internal pressures within the tank 12.

From the foregoing, it can be seen that the present invention provides a simple and yet effective extraction device. Having described my invention, however, many modifications thereto will become apparent to those skilled in the art to which it pertains without deviation from the spirit of the invention as defined by the scope of the appended claims.

I claim:

1. A withdrawal device for use with a cryogenic tank having a neck, said neck forming an opening having an interior surface into an interior of the tank, said withdrawal device comprising:

a housing, said housing having a flange adapted to overlie the neck of the cryogenic tank, an extraction tube having a first portion and a second portion, said first portion extending through said flange so that, with said flange overlying said neck, said first portion of said extraction tube extends into the interior of the tank, and said second portion extending laterally outwardly from said housing exteriorly of the tank, a valve fluidly connected in series with said second portion of said extraction tube, an axially compressible resilient annular seal adapted for insertion into the neck opening, means for mounting said seal to said housing so that one end of said seal abuts against said flange, said mounting means comprising a seal support which overlies the other end of said seal, an elongated rod having one end secured to said seal support, said rod extending through said flange and said housing so that a second end of said rod is positioned above said housing, said second end having a threaded portion, and a lever having threads which cooperate with said threaded portion of said rod threadably engaged with said rod threaded portion, wherein, with said flange positioned in abutment with said tank neck and said seal positioned in said neck opening, rotation of said rod axially compresses said seal so that said seal expands radially outwardly and sealingly engages the interior surface of said neck opening, said lever having a wall portion which limits axial travel of said rod.

2. The invention as defined in claim 1 wherein said rod threaded portion is externally threaded.

3. The invention as defined in claim 1 wherein said seal support comprises a circular disk having an outside diameter substantially the same as the outside diameter of said seal.

4. The invention as defined in claim 1 and comprising a pressure release valve mounted to said housing and open to the interior of the tank.

* * * * *